United States Patent [19]

Eckmann et al.

[11] 4,149,629

[45] Apr. 17, 1979

[54] DUAL MODE PRODUCT CONTAINER

[75] Inventors: John A. Eckmann, Pompano Beach, Fla.; Harry E. Lawrence, III, Glen Ridge, N.J.

[73] Assignee: Motorola, Inc., Schaumburg, Ill.

[21] Appl. No.: 854,552

[22] Filed: Nov. 25, 1977

[51] Int. Cl.[2] ..... B65D 81/00

[52] U.S. Cl. ..... 206/45.18; 248/174

[58] Field of Search ..... 206/45.18, 45.11, 44.11, 206/818; 248/174

[56] References Cited

U.S. PATENT DOCUMENTS

| | | | |
|---|---|---|---|
| 2,672,232 | 3/1954 | Kessell | 206/818 |
| 3,058,579 | 10/1962 | Marin | 206/45.11 |
| 3,397,771 | 8/1968 | Fogle | 206/45.11 |

FOREIGN PATENT DOCUMENTS

| | | | |
|---|---|---|---|
| 301594 | 10/1965 | Netherlands | 206/45.11 |
| 372800 | 7/1959 | Switzerland | 206/45.11 |

*Primary Examiner*—Herbert F. Ross

*Attorney, Agent, or Firm*—Margaret Marsh Parker; James W. Gillman

[57] ABSTRACT

A container for a product serves to protect the product during shipping and storage, then opens to display the product. A bridge member attached to the inner walls of the container retains the product on a planar surface which is centrally located within the container in the protect mode and is elevated above the container in the display mode. A magnetic latch within the walls of the container holds the container in the display mode.

8 Claims, 13 Drawing Figures

Fig. 1
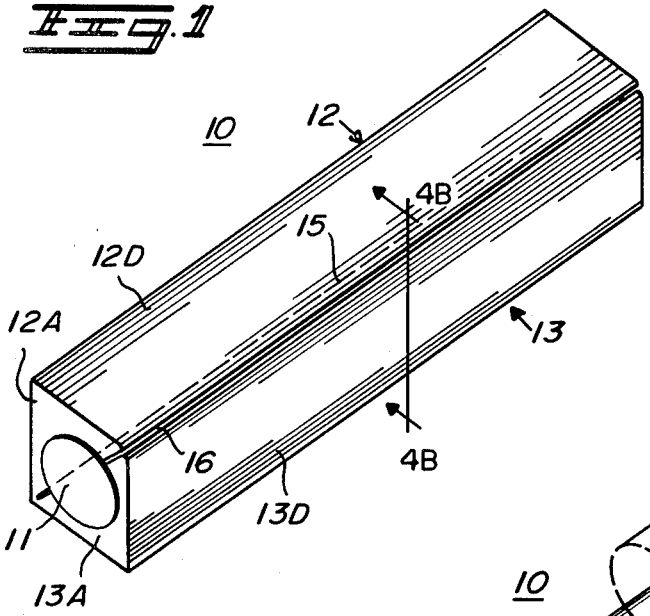
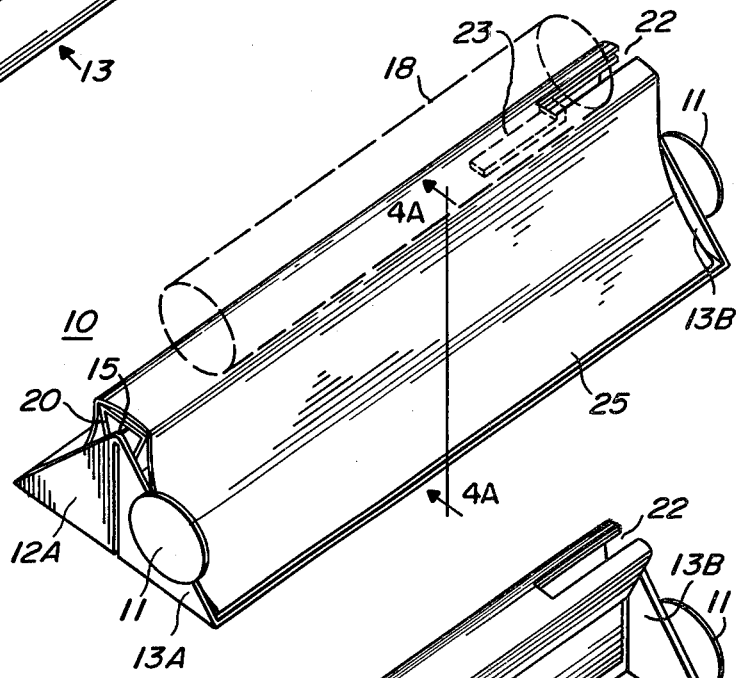
Fig. 2
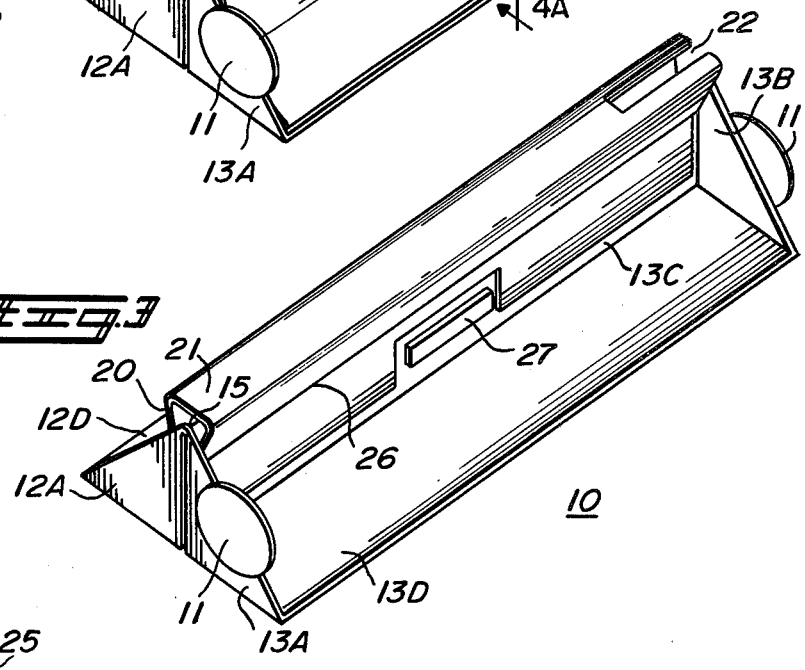
Fig. 3
Fig. 4A
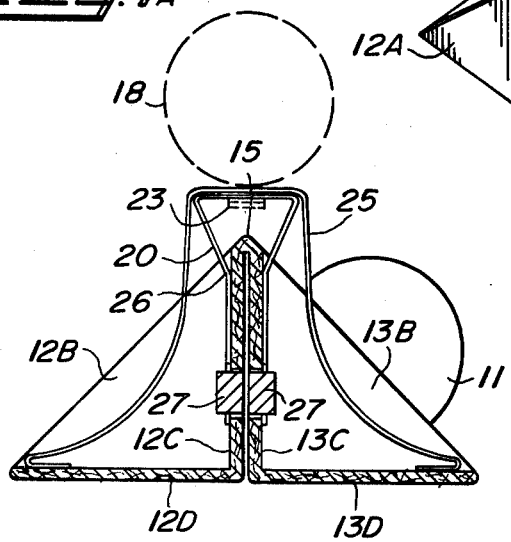
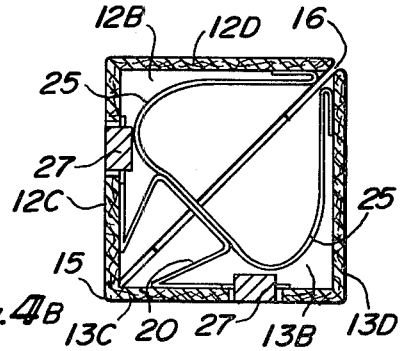
Fig. 4B

DUAL MODE PRODUCT CONTAINER

BACKGROUND OF THE INVENTION

This invention relates to the field of product containers and more particularly to containers which can serve alternativly as protection and display devices.

Many containers are known to be convertible from mere packages to display devices, for example, a simple box such as those typically used for pen and pencil sets. These have a hinge-attached lid portion which may be rotated through 90° to the vertical position where they will remain, usually to display the manufacturer's name or trademark. Other types of packaging provide more elaborate or attractive displays, but typically require rearrangement of the package portions, e.g. bending and inserting tabs, setting up bracing portions and the like, with the reverse action required after a sale is made. The latter type is particularly unsuited to very small packages from a structural point of view, and is difficult to design wirh sufficient eye appeal for small items to be displayed within a show case.

SUMMARY OF THE INVENTION

It is, therefore, an object of the present invention provide a small container for a product which will alternatively protect or display the product.

It is a particular object to provide an effective and novel display device.

It is another particular object to provide a protective container requiring no set-up time to convert it to a display device and back to a container.

The above objects and others are provided in a container constructed in accordance with the present invention. Two rigid housing members are joined by a hinge portion, each member having a planar portion adjacent the hinge portion. The container may be held closed by adhesive seals which also serve as labels. A bridge member is mounted on the inside of the housing members and forms a raised portion having a central surface. The surface is adapted to support and retain the product centrally of the container during shipping, storage, etc., for maximum protection. When the container is opened for display purposes, one housing half pivots through a large angle until the planar portions are in contact and are held together by a magnetic latch contained within the planar portions. The central surface of the bridge then holds the product in an elevated position above the container for an effective display. A sheet of a strong flexible material having an attractive surface may cover the inner walls and the bridge member to help support the bridge portion, enhance the appearance of the display device and carry any desired indicia.

BRIEF DESCRIPTION OF THE DRAWING

FIG. 1 is a perspective view of one embodiment of the invention in the protect mode.

FIG. 2 is a perspective view of the same embodiment in the display mode.

FIG. 3 is the view of FIG. 2 with the decorative lining removed.

FIG. 4A is a sectional view along the line 4A—4A of FIG. 2.

FIG. 4B is a sectional view along the line 4B—4B of FIG. 1.

DETAILED DESCRIPTION OF A PREFERRED EMBODIMENT

Figure 5A:
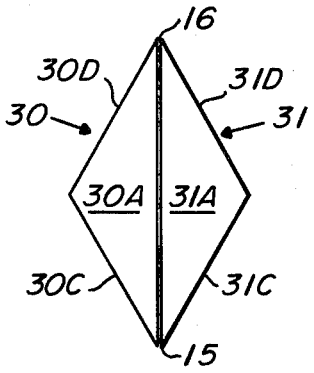
FIGS. 5A and 5B are plan views of another embodiment of the invention in the two modes.

The present invention is best understood with respect to the accompanying drawings in which like parts have like numerals throughout the various figures.

The embodiments of the invention as illustrated might be utilized with a small tubular product which has an attached clip device for retaining the product in the pocket of the ultimate user. The invention is, of course, not limited to any particular product or type of product.

In FIG. 1, an exemplary container is shown in the protect mode, i.e., closed and sealed as it would be during shipping or storage. The container, referenced generally as numeral 10, could be held closed by semi-rigid adhesive seals 11 applied to the ends thereof and bearing indicia as to the product and its source. Such seals would preferably be removable and replaceable at least several times without losing adhesion. Other means of closing the container could, of course, be used. As may be seen in FIG. 1, the outer part of the container 10 is formed of two housing members 12 and 13, hinged along a line 15 (dotted line in this view) and opening along the line 16.

In FIG. 2, the seals 11 have been loosened and the container 10 has been opened and latched in the display mode position. An exemplary product is indicated by dotted lines 18. As may be seen, each housing member 12 and 13 is formed from two isosceles triangular-shaped end portions, 12A and 12B (shown in FIGS. 4A and 4B), 13A and 13B, and two rectangular side portions 12C, 12D and 13C, 13D. The housing members 12 and 13 and the joining hinge may be of any suitable thin-walled material, fabricated either as a unitary molding or as two sections covered and joined by a strong, flexible material. Attached to the sides 12C and 13C and extending above the hinged line 15 is a bridge portion 20. The bridge portion 20 is preferably formed of a thin, semi-rigid material which can be formed or folded (see FIGS. 3 and 4) but which will flex slightly without breaking as the container 10 is opened and closed. The central portion of the bridge 20 includes a planar surface 21 upon which the product 18 may be supported and retained. The resilience of the bridge portion 20 provides shock mounting for the product 18 during shipping and handling. The product 18 is shown attached to a slot 22 of the bridge 20 by a clip 23 with which product 18 would ultimately be fastened to the user's pocket. Other means of attachment to the planar surface 21 could be used with products not having such a clip.

A flexible lining 25, e.g., a fabric-backed foil, may be used within the container to give added support to the bridge portion 20 and to provide more eye appeal. Indicia may also be imprinted on the lining. The edges of the lining 25 would preferably be turned under and attached firmly to the inner walls of the sides 12D and 13D. The center section of the lining 25 would be attached to the planar surface 21 with enough material on each side to allow the lining to assume a concave surface between the points of attachment, as may be seen in FIGS. 2 and 4.

In FIG. 3 the container 10 is shown without the lining 25. The edges of the bridge portion 20 are fixedly attached to the inner surfaces of walls 12C and 13C up to a line 26.

As clearly shown in FIGS. 4A and 4B, the conformation of the bridge portion 20 is such as to provide the maximum rigidity to the upper section of the bridge portion 20 for supporting the displayed product in a horizontal or very nearly horizontal position. For a particularly heavy product, the lining 25 would be made of a stiffer or semi-rigid material, such as a thin metal or formed plastic, acting as a pair of opposed springs to maintain the product in the horizontal position while the container is in the display mode. If other than a horizontal display position should be desired, only the dimensions of the bridge portion need be changed, and no perceptible loss in stability will occur with reasonable dimensions.

Also attached to the walls 12C, 13C, and preferably implanted in the walls, is a magnetic latch 27 which could consist of two magnets oriented for mutual attraction, or one magnet and one piece of magnetic material, preferably ferromagnetic. The parts the magnetic latch 27 are preferably not visible from the outside of the container, but should be as close to the outer surface of the side walls as possible for maximum attraction. When the container is in the display mode, the magnetic latch 27 should be concealed, as by the lining 25.

The sectional view of FIG. 4A shows the container in the display mode and FIG. 4B shows the protect mode. The flexures of the bridge portion 20 and the lining material 25 are shown more clearly by a comparison of these two views.

FIG. 4A, one housing member 12 or 13 has been rotated through 270° relative to the other housing member, bringing the side portions 12C and 13C into abutting relationship. The portions of the magnetic latch 27 are adjacent and magnetic attraction holds the housing 10 in the display mode. The housing side portions 12D and 13D provide a support which keeps the planar surface 21 essentially horizontal when the container is in the display mode.

Figure 5B:
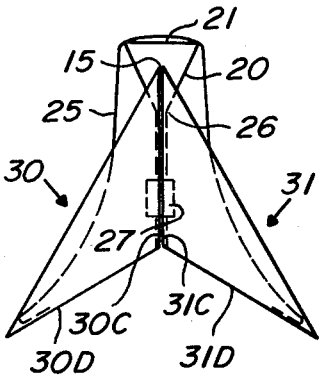
Figure 6A:
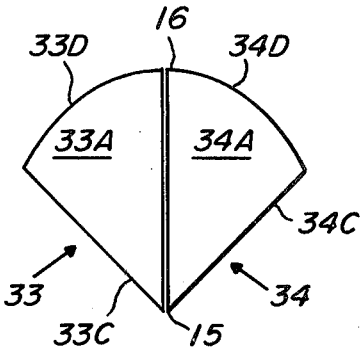
FIGS. 6A and 6B are plan views of another embodiment of the invention.
Figure 6B:
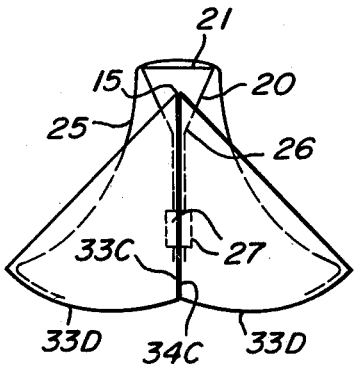
Figure 7A:
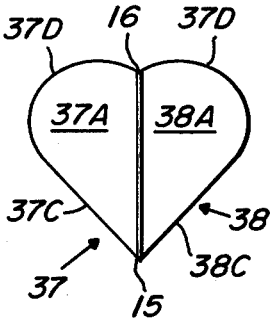
FIGS. 7A and 7B are plan views of still another embodiment.
Figure 7B:
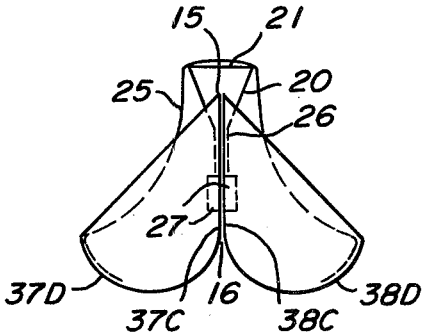
Figure 8A:
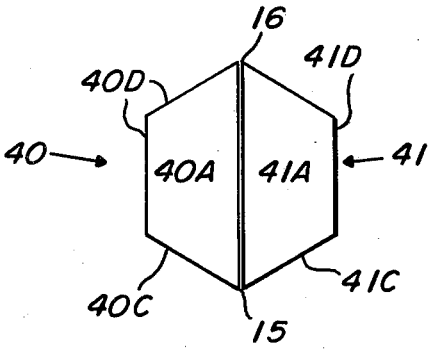
FIGS. 8A and 8B are plan views of yet another embodiment.
Figure 8B:
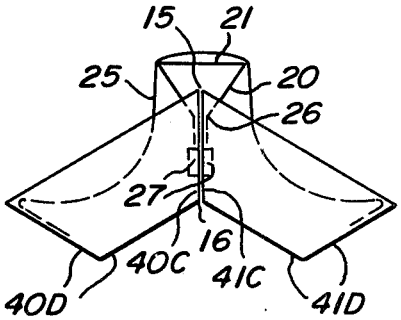

The remaining views 5A and 5B, 6A and 6B, 7A and 7B, 8A and 8B have the same structure as the one described hereinabove, the only difference being in the external configuration. The housing members 30 and 31, 33 and 34, 37 and 38, 40 and 41 in the respective figures all rotate through an angle relative to each other which varies from 240° (FIGS. 8A and 8B) to more than 270° (FIGS. 5A and 5B). In each embodiment of the invention, the open container provides a stable support for the displayed product which is elevated above the open container.

Thus, there has been shown and described a dual mode container having both a protect mode and display mode. In the protect mode, the contained product is supported on a slightly resilient bridge surface away from all outside walls. In the display mode, the hinged sides are swung back against each other and latched by a magnetic latch, with the bridge surface elevated for an effective product display. The invention may have numerous modifications and variations and it is intended to include all such as fall within the spirit and scope of the appended claims.

What is claimed is:

1. A dual mode container for protecting and displaying a product and including in combination:

two housing members for enclosing a space substantially larger than the product, each member having end portions and side portions including at least one planar side portion;

a hinge portion for joining a planar portion of one housing member to a planar portion of the second housing member, one planar portion being rotatable through an angle substantially more than 180° relative to the other planar portion and into contact therewith;

magnetic means retained by the planar portions of the housing members for releasably latching said portions in the contacting position;

closure means for releasably retaining housing members in the closed position for the protect mode;

a bridge member attached to the interior of each housing member and a portion of the bridge member forming an elevated planar surface above the hinge portion for supporting the product, the planar surface being centrally located within the container in the protect mode and elevated above the container in the display mode; and means for releasably retaining the product on the planar surface of the bridge portion.

2. A dual mode container according to claim 1 wherein each housing member includes two isosceles-triangular end portions and two side portions attached to the shorter sides of the triangular end portions, the two housing members forming a rectangular solid when in the protect mode and an isosceles-triangular solid when in the display mode.

3. A dual mode container according to claim 1 wherein the magnetic means comprises two magnets oriented for mutual attraction.

4. A dual mode container according to claim 1 wherein the closure means is an adhesive seal.

5. A dual mode container according to claim 4 wherein the adhesive seal bears indicia.

6. A dual mode container according to claim 1 and further including a flexible lining attached at two edges thereof to the inside walls of the container and extending over said bridge portion.

7. A dual mode container according to claim 6 wherein said flexible lining forms a pair of opposed springs for supporting said bridge portion.

8. A dual mode container according to claim 1 wherein the product retaining means includes a slot for receiving a portion of the contained product.

* * * * *